US006609514B1

(12) United States Patent
Bertolas

(10) Patent No.: US 6,609,514 B1
(45) Date of Patent: Aug. 26, 2003

(54) PORTABLE FIRE PIT AND FIRE PIT STAND

(76) Inventor: Annette L. Bertolas, N89 W28351 Getaway La., Hartland, WI (US) 53029

( * ) Notice: Subject to any disclaimer, the term of this patent is extended or adjusted under 35 U.S.C. 154(b) by 0 days.

(21) Appl. No.: 10/313,871

(22) Filed: Dec. 9, 2002

(51) Int. Cl.[7] ..... F24B 1/181; F23Q 2/32
(52) U.S. Cl. ..... 126/519; 431/125
(58) Field of Search ..... 126/519, 42, 43, 126/92 R, 92 AC; 431/125

(56) References Cited

U.S. PATENT DOCUMENTS

| | | | | | |
|---|---|---|---|---|---|
| 3,582,250 | A | | 6/1971 | Chatfield | 431/125 |
| 4,076,490 | A | * | 2/1978 | Hilker | 431/125 |
| 4,100,912 | A | * | 7/1978 | Doane | 126/43 |
| 4,150,610 | A | * | 4/1979 | Ferrara | 99/419 |
| 5,026,271 | A | | 6/1991 | Orlov et al. | 431/125 |
| 6,227,192 | B1 | * | 5/2001 | Schake | 126/246 |
| 6,267,111 | B1 | * | 7/2001 | Burton | 126/268 |
| 6,267,113 | B1 | * | 7/2001 | Maust et al. | 126/512 |
| 6,354,288 | B1 | | 3/2002 | McDonald | 126/519 |

* cited by examiner

*Primary Examiner*—Alfred Basichas
(74) *Attorney, Agent, or Firm*—Donald J. Ersler

(57) ABSTRACT

A portable fire pit includes an elevated platform, a fire pit, at least one container of fuel, and at least one support device. The at least one support device is attached to the elevated platform. The fire pit is retained within the elevated platform. The fuel is placed in the fire pit. At least one decorative item may be placed in the fire pit, around the fuel. The fuel is ignited. A fire pit stand includes a pedestal, a fire pit, at least one container of fuel and a cover. The fire pit is retained in a top of the pedestal. The fuel is placed in the fire pit. The cover is suspended over the pedestal with any appropriate method. The fuel is ignited to display a large flame.

17 Claims, 5 Drawing Sheets

PORTABLE FIRE PIT AND FIRE PIT STAND

BACKGROUND OF THE INVENTION

1. Field of the Invention

The present invention relates generally to fireplaces and more specifically to a portable fire pit and fire pit stand, which allow a simulated log fire or large flame to be enjoyed from 360 degree view without the necessity of special ventilation or transportation of combustible gas.

2. Discussion of the Prior Art

There are numerous fireplaces that use combustible gas, alcohol, or gel fuel to simulate burning coals or logs. U.S. Pat. No. 3,582,250 to Chatfield discloses a gas fired fireplace basket. The gas fired fireplace basket simulates a coal fire using combustible gas burners. However, Chatfield is a fireplace insert and not a free standing fireplace. U.S. Pat. No. 5,026,271 to Orlov et al. discloses a log or coal effect fire. The log or coal effect fire includes a slidable drawer for receiving gel fuel. However, Orlov et al. is a fireplace insert and not a free standing fireplace U.S. Pat. No. 6,354,288 to McDonald discloses a portable fireplace. The portable fireplace includes an outer housing with a fire pit formed in an inner housing. However, McDonald may not be used indoors in many states, because a fireplace, which utilizes a combustible gas produces carbon monoxide as a byproduct and requires ventilation.

Accordingly, there is a clearly felt need in the art for a portable fire pit, which produces a fire that may be burned on an outdoor deck fabricated from a combustible material, indoors without ventilation, and may be viewed from 360 degrees. There is a clearly felt need in the art for a portable fire pit stand, which displays a fire without the need for ventilation or transporting combustible gas.

SUMMARY OF THE INVENTION

The present invention provides a portable fire pit and fire pit stand, which do not need ventilation and allow a simulated log fire or large flame to be enjoyed without the necessity of special ventilation or transportation of combustible gas. The portable fire pit includes an elevated platform, a fire pit, at least one container of fuel and at least one support device. The at least one support device is used to lift the elevated platform off a support surface. The fire pit is retained within the elevated platform. The elevated platform may be fabricated out of a combustible material. The fuel is either a gel fuel or some type of alcohol fuel derivative. A container grate may be placed on a bottom of the fire pit to reduce heat transfer to a bottom of the fire pit. The at least one container of fuel is placed in the fire pit.

At least one decorative item may be placed in the fire pit, around the at least one container of fuel such as a noncombustible log, noncombustible coals, stones, or any other item. A second embodiment of a fire pit includes a pit cover plate. The pit cover plate includes at least one hole to allow the emission of fire from the at least one container of fuel. The at least one decorative item may be placed on top of the pit cover plate. Each container of fuel may be inserted into a decorative container surround. The decorative container surround improves the appearance of each container of fuel.

The portable fire pit is preferably used in the following manner. The at least one container of fuel is ignited. The fire generated by the at least one container of fuel does not require ventilation. The fire is preferably extinguished by using a snuffer device. The snuffer device includes a cover extending from a pivoting rod. The cover is placed on top of the at least one container of fuel, until the flame is extinguished. The container lid is then secured to the container of fuel.

A fire pit stand includes a pedestal, a fire pit, at least one container of fuel and a cover. The fire pit is retained in a top of the pedestal. The pedestal may be fabricated out of a combustible material. The fuel is either a gel fuel or some type of alcohol fuel derivative. The at least one container of fuel is placed in the fire pit. The cover is suspended over the pedestal with any appropriate method, such that there is sufficient clearance for an unobstructed flame to be viewed. The at least one container of fuel is ignited. The fire generated by the at least one container of fuel does not require ventilation. The fire is preferably extinguished by using a snuffer device. The snuffer device includes a cover extending from a pivoting rod. The cover is placed on top of the at least one container of fuel, until the flame is extinguished. A container lid is then secured to the container of fuel.

Accordingly, it is an object of the present invention to provide a portable fire pit, which provides the enjoyment of a fire indoors without requiring ventilation.

It is a further object of the present invention to provide a portable fire pit, which includes a horizontal mantle that allows a fire to be viewed from 360 degrees.

It is yet a further object of the present invention to provide a portable fire pit, which does not require a combustible gas tank to transported when the portable fire pit is used.

Finally, it is another object of the present invention to provide a fire pit stand, which provides a large flame from an artistic work without requiring ventilation.

These and additional objects, advantages, features and benefits of the present invention will become apparent from the following specification.

DETAILED DESCRIPTION OF THE PREFERRED EMBODIMENTS

Figure 1:
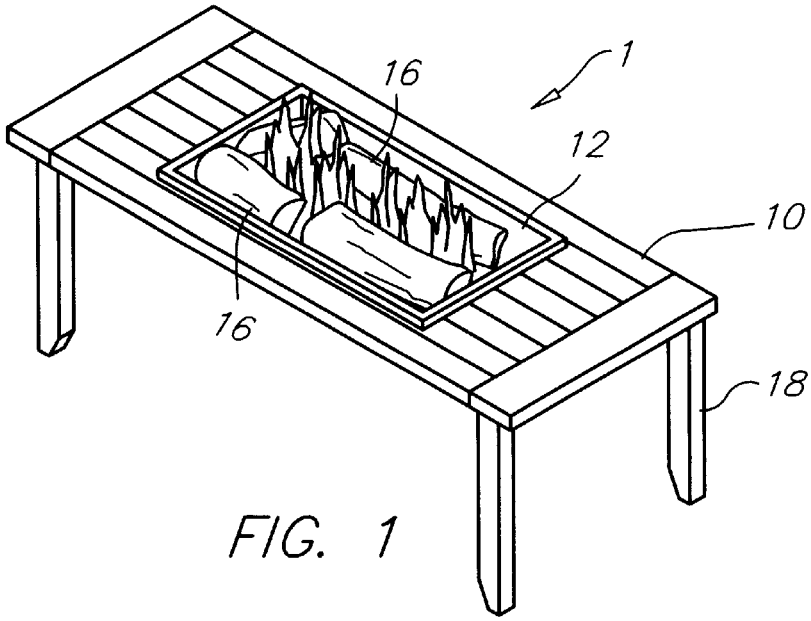
FIG. 1 is a perspective view of a portable fire pit in accordance with the present invention.
Figure 2A:
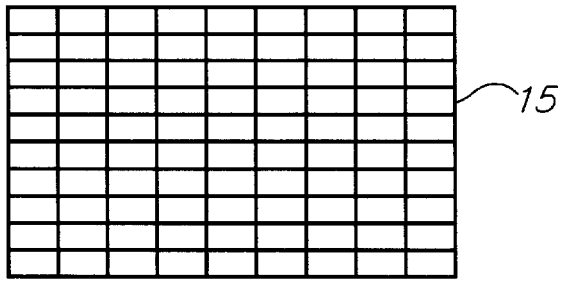
FIG. 2*a* is a top view of a container grate of a portable fire pit in accordance with the present invention.
Figure 2:
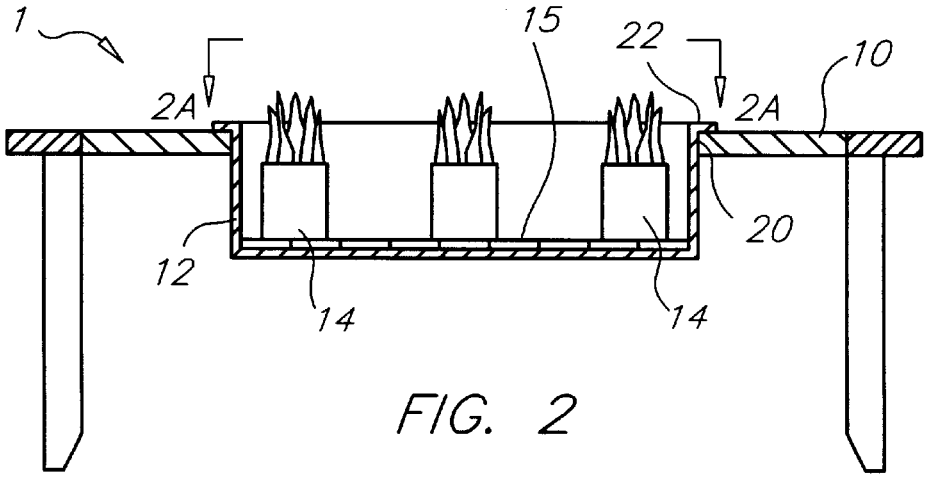
FIG. 2 is a side cross sectional view of a portable fire pit without at least one decorative item in accordance with the present invention.
Figure 3:
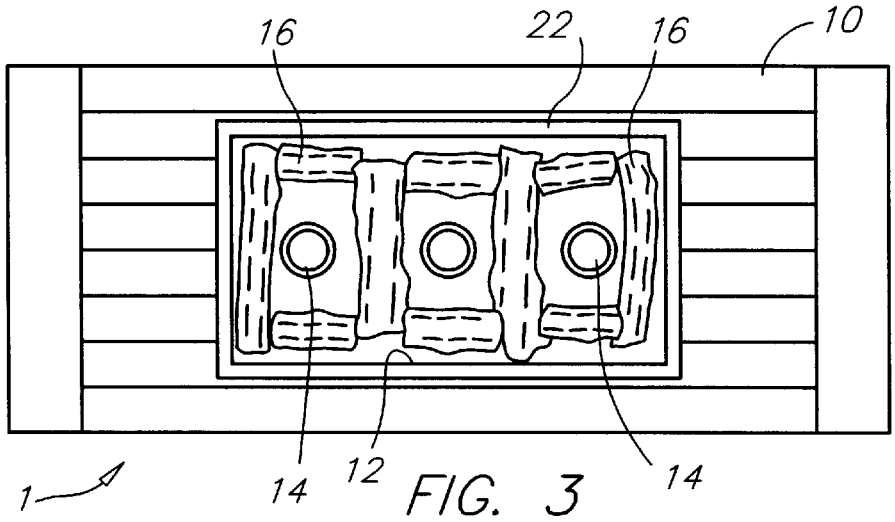
FIG. 3 is a top view of a portable fire pit in accordance with the present invention.

With reference now to the drawings, and particularly to FIG. 1, there is shown a perspective view of a portable fire pit 1. With reference to FIGS. 2–3, the portable fire pit 1 includes an elevated platform 10, a fire pit 12, at least one container of fuel 14, and at least one support device 18. The at least one support device 18 is attached to the elevated platform 10 to lift the elevated platform 10 off a support surface, such as a deck or floor. FIGS. 1–3 illustrate the use of a coffee table having an elevated platform 10 and the at least one support device 18. However, other combinations of elevated platforms and at least one support device may also be used. A support device may also be used to support the elevated platform from a ceiling, a tripod or from above the elevated platform.

Preferably, an opening 20 is formed in the elevated platform 10 to receive the fire pit 12. Preferably a flange 22 is formed on a top perimeter of the fire pit 12. The flange 22 allows the fire pit 12 to be inserted and retained in the elevated platform 10 without the need for fastening thereof to the elevated platform 10. However, other attachment methods may also be used to retain the fire pit 12 in the elevated platform 10. Other designs and configurations of fire pits may also be used. Further, the elevated platform 10 may be fabricated from a combustible material such as wood. The heat absorbed by the fire pit 12 and transferred to the elevated platform 10 is minimal. Preferably the height of the elevated platform 10 allows the fire pit 12 to be accessed from a bottom thereof. With reference to FIG. 2*a*, a container grate 15 is placed on a bottom of the fire pit 12. The container grate 15 is used to reduce heat transfer to a bottom of the fire pit. When a container of fuel 14 is low on fuel, heat from the flame will be conducted from a bottom of the container of fuel 14.

Figure 2B:
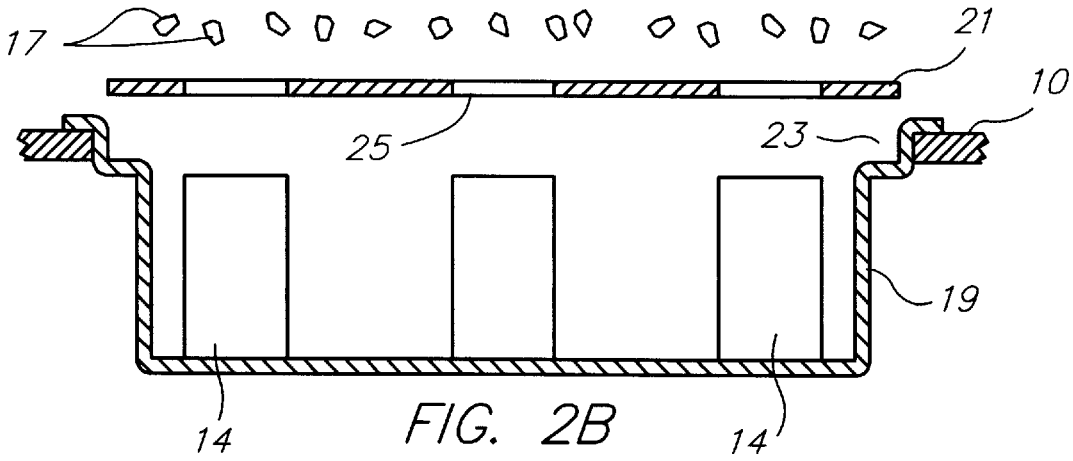
FIG. 2*b* is a side cross sectional view of a second embodiment of a fire pit of a portable fire pit in accordance with the present invention.
Figure 2C:
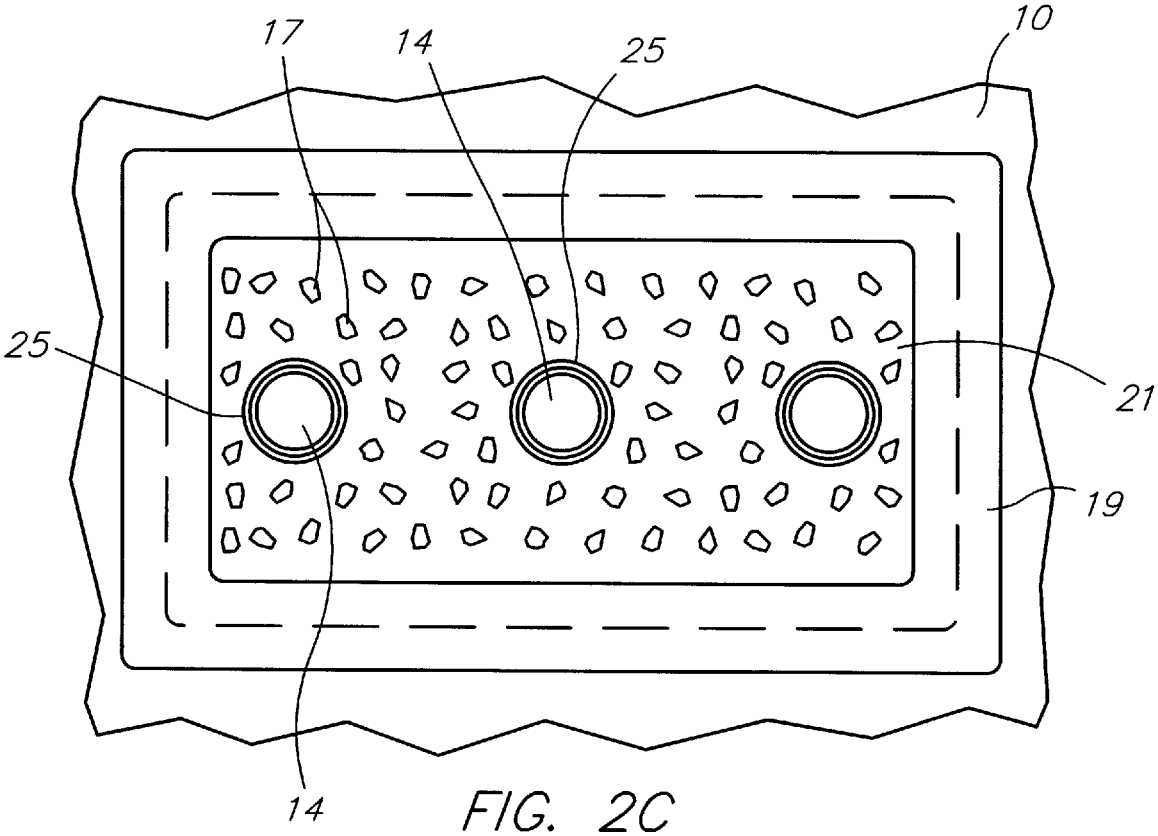
FIG. 2*c* is a top view of a second embodiment of a fire pit of a portable fire pit in accordance with the present invention.
Figure 2D:
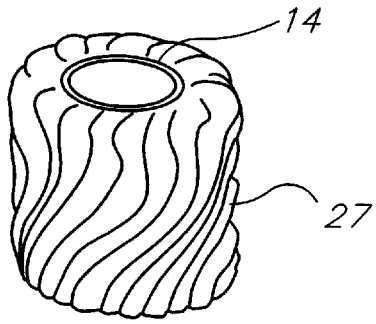
FIG. 2*d* is a perspective view of a decorative container surround that receives a container of fuel of a portable fire pit in accordance with the present invention.

At least one decorative item may be placed in the fire pit, around the at least one container of fuel 14 such as a noncombustible log 16, noncombustible coals 17, stones, or any other item. With reference to FIGS. 2*b* & 2*c*, a second embodiment of a fire pit 19 includes a pit cover plate 21. A recessed flange 23 is preferably formed in the fire pit 19 to receive the pit cover plate 21. The pit cover plate 21 includes at least one hole 25 to allow the emission of fire from the at least one container of fuel 14. The at least one decorative item may be placed on top of the pit cover plate 21, such as a plurality of noncombustible coal 17. With reference to FIG. 2*d*, each container of fuel 14 may be inserted into a decorative container surround 27. The decorative container surround 27 improves the appearance of each container of fuel 14.

The fuel in the at least one container is either a gel fuel or some type of alcohol fuel derivative. The fuel must not essentially produce carbon monoxide as a byproduct when burned, if the portable fire pit 1 is used indoors. Alcohol fuel derivatives do not essentially produce carbon monoxide as a byproduct when burned. The at least one container of fuel 14 is preferably placed in the fire pit 12. At least one decorative item may be placed around the at least one container of fuel 14.

Figure 4A:
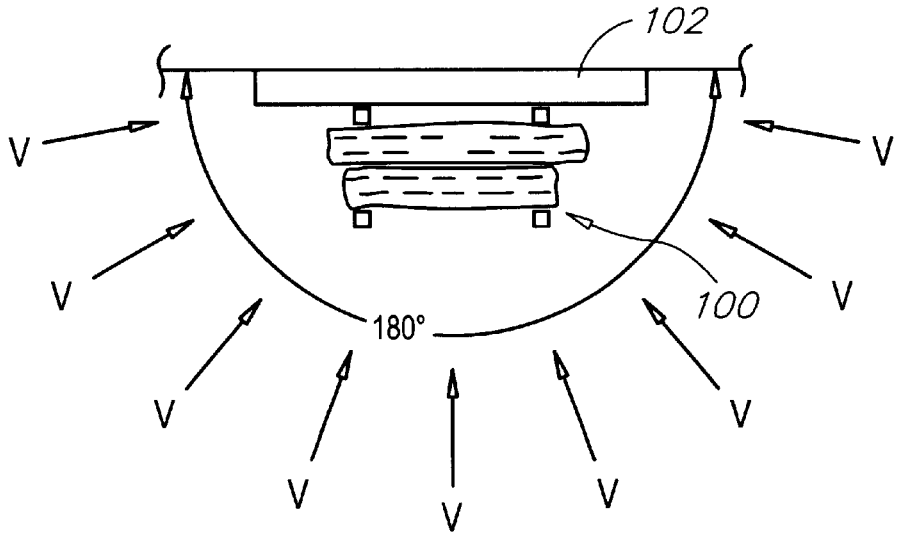
FIG. 4A (PRIOR ART)
FIG. 4*a* is a top view of a prior art fire place, illustrating 180 degree visibility.
Figure 4B:
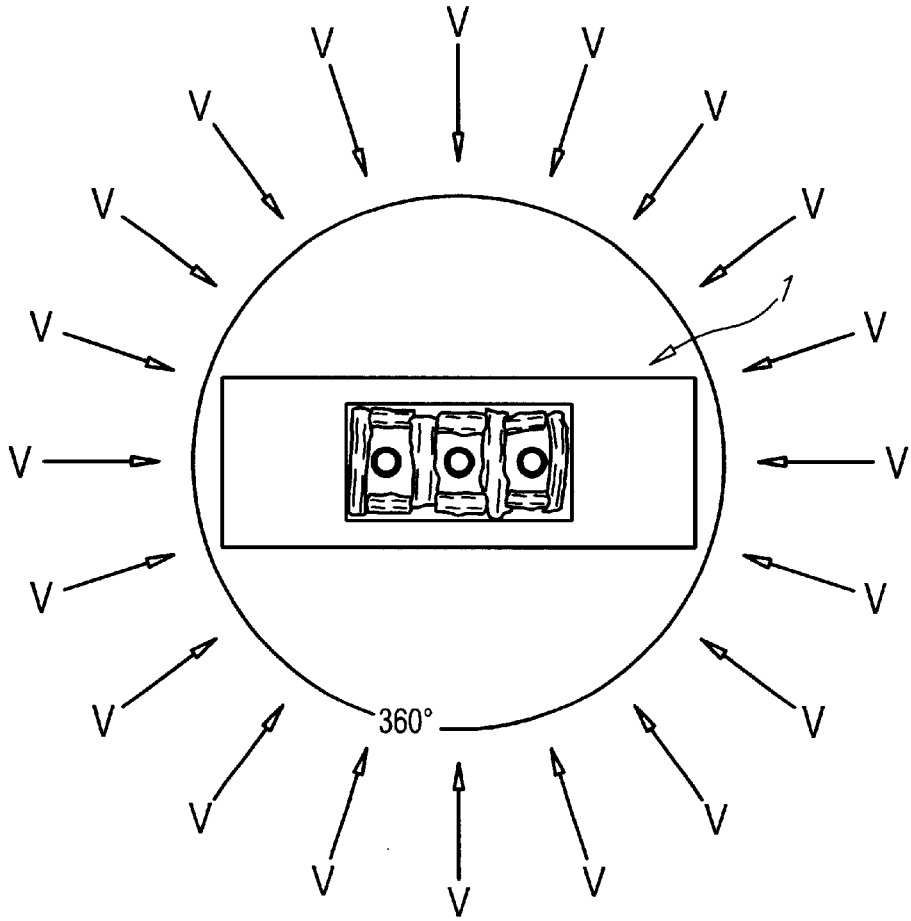
FIG. 4*b* is a top view of a portable fire pit illustrating 360 degree visibility in accordance with the present invention.

The portable fire pit 1 is preferably used in the following manner. The at least one container of fuel 14 is ignited. The fire generated by the at least one container of fuel 14 does not require ventilation indoors as long as an alcohol fuel derivative is used. With reference to FIGS. 4*a* and 4*b*, the fire from the at least one container of fuel 14 creates a fire, which may be viewed from 360 degrees. A tradition fireplace 100 has a vertical mantle 102, which only allows viewing from 180 degrees. The elevated platform 10 acts as a horizontal mantle, allowing a view from 360 degrees.

Figure 5A:
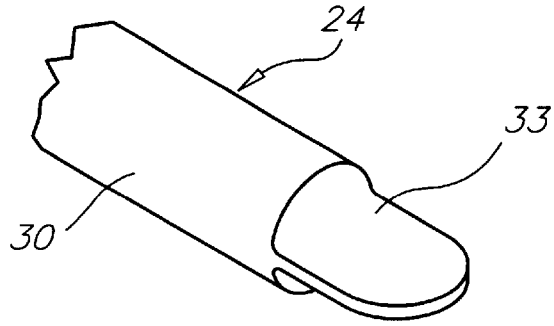
FIG. 5*a* is an enlarged perspective view of the other end of a second rod member of a snuffer device for use with a portable fire pit or fire pit stand in accordance with the present invention.
Figure 5:
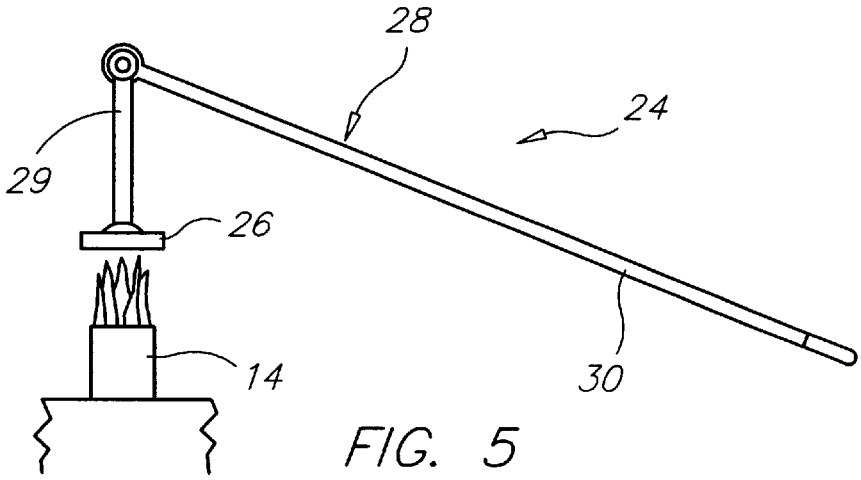
FIG. 5 is a side view of a snuffer device for use with a portable fire pit or fire pit stand in accordance with the present invention.

With reference to FIG. 5, the fire in the at least one container of fuel 14 is preferably extinguished with a snuffer device 24. The snuffer device 24 preferably includes a cover 26, and a pivoting rod 28. The pivoting rod 28 includes a first rod member 29 and a second rod member 30. The cover 26 must be large enough to cover an opening in a container of fuel 14. The cover 26 is attached to one end of the first rod member 29. The other end of the first rod member 29 is pivotally attached to one end of the second rod member 30. The other end of the second rod member is formed as a lid remover 33. The lid remover 33 is used to pry the lid off a container of fuel 14. The cover 26 is placed on top of the at least one container of fuel 14 to put out a fire.

Figure 6:
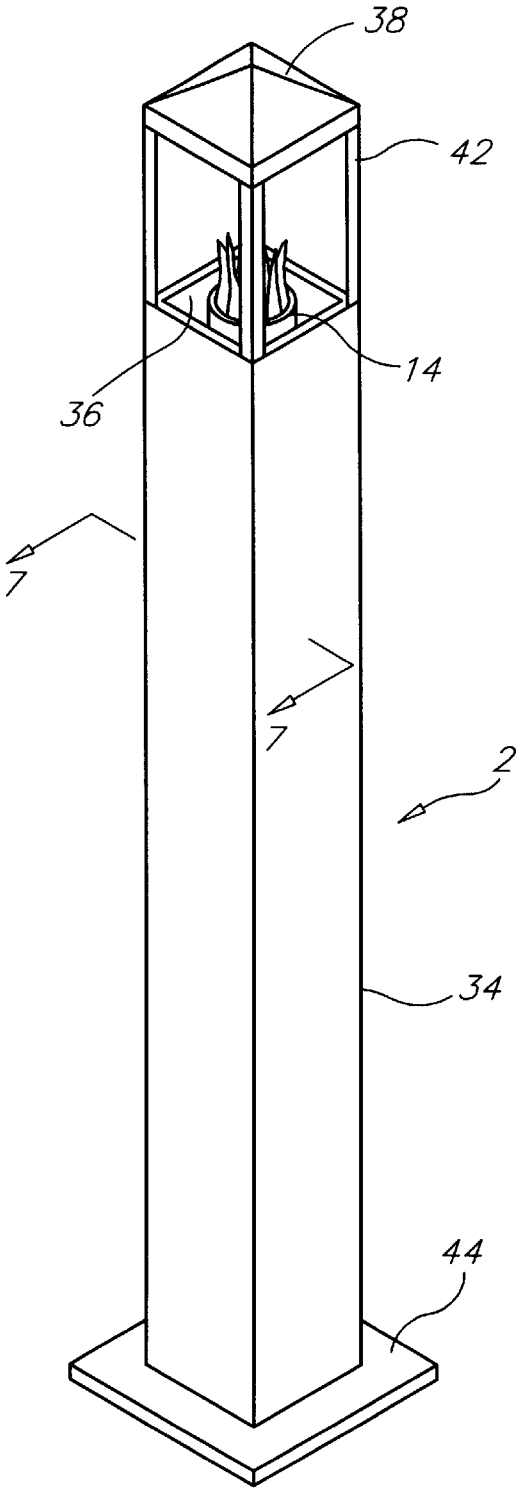
FIG. 6 is a perspective view of a fire pit stand in accordance with the present invention.
Figure 7:
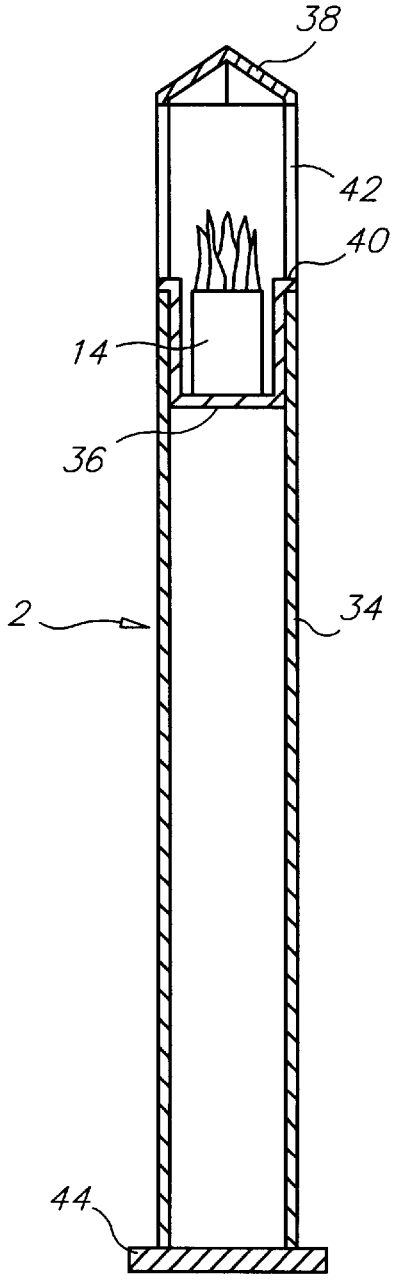
FIG. 7 is a cross sectional view of a fire pit stand in accordance with the present invention.

With reference to FIGS. 6 and 7, a fire pit stand 2 includes a pedestal 34, a fire pit 36, the at least one container of fuel 14 and a cover. 38. The fire pit 36 is retained in a top of the pedestal 34. An outer perimeter of the fire pit 36 is sized to be received by an inner perimeter of the pedestal 34. A flange 40 is preferably formed on a top perimeter of the fire pit 36. The flange 40 allows the fire pit 12 to be inserted and retained in the pedestal 34 without the need for fastening thereof to the pedestal 34. However, other attachment methods may also be used to retain the fire pit 36 in the pedestal 34. Further, the pedestal 34 may be fabricated from a combustible material. The heat absorbed by the fire pit 36 and transferred to the pedestal 34 is minimal.

The fuel in the at least one container is either a gel fuel or some type of alcohol fuel derivative. The fuel must not essentially produce carbon monoxide as a byproduct when burned, if the fire pit stand 2 is used indoors. The at least one container of fuel 14 is preferably placed in the fire pit 36. The at least one container of fuel 14 may be placed in a decorative container surround 27. The cover 38 is preferably suspended over the fire pit 36 with at least two support posts 42; however, other suitable methods may also be used. The cover 38 is suspended over the pedestal with any appropriate method, such that there is sufficient clearance for an unobstructed flame to be viewed. The pedestal may be attached to a base 44 to provide extra stability.

The fire pit stand 2 is preferably used in the following manner. The at least one container of fuel 14 is ignited. The fire generated by the at least one container of fuel 14 does not require ventilation indoors as long as an alcohol fuel derivative is used. The fire in the at least one container of fuel 14 is preferably extinguished with a snuffer device 24.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of providing a decorative open flame fire comprising the steps of:

providing an elevated platform supported by at least one support device, said elevated platform being fabricated from a combustible material;

forming a fire pit in said elevated platform, a bottom of said fire pit being disposed below said elevated platform, said elevated platform having a surface area that is substantially greater than a surface area of said fire pit;

placing at least one container of fuel in said fire pit; and igniting said at least one container of fuel.

2. The method of providing a decorative open flame fire of claim 1, further comprising the step of:

placing at least one decorative item in said fire pit.

3. The method of providing a decorative open flame fire of claim 1, further comprising the step of:

providing said at least one container of fuel such that thereof does not essentially emit carbon monoxide when burned.

4. The method of providing a decorative open flame fire of claim 1, further comprising the step of:

placing one of said at least one container of fuel in a decorative container surround.

5. The method of providing a decorative open flame fire of claim 1, further comprising the step of:

providing a grate that is placed on a bottom of said fire pit.

6. The method of providing a decorative open flame fire of claim 1, further comprising the step of:

placing a pit cover plate over said fire pit, said pit cover plate having an opening for each one of said at least one container of fuel.

7. A method of providing a decorative open flame fire comprising the steps of:

providing an elevated platform supported by at least one support device, said elevated platform being fabricated from a combustible material;

forming a fire pit in said elevated platform, a bottom of said fire pit being disposed below said elevated platform, said elevated platform having a surface area that is substantially greater than a surface area of said fire pit;

placing a grate on a bottom of said fire pit;

placing at least one container of fuel on said grate; and igniting said at least one container of fuel.

8. The method of providing a decorative open flame fire of claim 7, further comprising the step of:

placing at least one decorative item in said fire pit.

9. The method of providing a decorative open flame fire of claim 7, further comprising the step of:

providing said at least one container of fuel such that thereof does not essentially emit carbon monoxide when burned.

10. The method of providing a decorative open flame fire of claim 7, further comprising the step of:

placing one of said at least one container of fuel in a decorative container surround.

11. The method of providing a decorative open flame fire of claim 7, further comprising the step of:

placing a pit cover plate over said fire pit, said pit cover plate having an opening for each one of said at least one container of fuel.

12. A method of providing a decorative open flame fire comprising the steps of:

providing a table having an elevated platform and at least one support device, said at least one support device extending from said elevated platform, said elevated platform being fabricated from a combustible material;

forming a fire pit in said elevated platform, a bottom of said fire pit being disposed below said elevated platform, said elevated platform having a surface area that is substantially greater than a surface area of said fire pit;

placing at least one container of fuel in said fire pit; and igniting said at least one container of fuel.

13. The method of providing a decorative open flame fire of claim 12, further comprising the step of:

placing at least one decorative item in said fire pit.

14. The method of providing a decorative open flame fire of claim 12, further comprising the step of:

providing said at least one container of fuel such that thereof does not essentially emit carbon monoxide when burned.

15. The method of providing a decorative open flame fire of claim 12, further comprising the step of:

placing one of said at least one container of fuel in a decorative container surround.

16. The method of providing a decorative open flame fire of claim 12, further comprising the step of:

providing a grate that is placed on a bottom of said fire pit.

17. The method of providing a decorative open flame fire of claim 12, further comprising the step of:

placing a pit cover plate over said fire pit, said pit cover plate having an opening for each one of said at least one container of fuel.

* * * * *